US008235229B2

(12) United States Patent
Singhose et al.

(10) Patent No.: US 8,235,229 B2
(45) Date of Patent: Aug. 7, 2012

(54) METHODS AND SYSTEMS FOR DOUBLE-PENDULUM CRANE CONTROL

(75) Inventors: William Earl Singhose, Atlanta, GA (US); Dooroo Kim, Marietta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 222 days.

(21) Appl. No.: 12/362,793

(22) Filed: Jan. 30, 2009

(65) Prior Publication Data

US 2009/0194498 A1 Aug. 6, 2009

Related U.S. Application Data

(60) Provisional application No. 61/025,110, filed on Jan. 31, 2008.

(51) Int. Cl.
*B66C 13/06* (2006.01)

(52) U.S. Cl. ..... 212/275; 212/272

(58) Field of Classification Search ..... 212/272, 212/275

See application file for complete search history.

(56) References Cited

U.S. PATENT DOCUMENTS

| | | | | |
|---|---|---|---|---|
| 4,756,432 | A | 7/1988 | Kawashima et al. | |
| 4,916,635 | A | 4/1990 | Singer et al. | |
| 4,997,095 | A | 3/1991 | Jones et al. | |
| 5,127,533 | A | 7/1992 | Virkkunen | |
| 5,526,946 | A | 6/1996 | Overton | |
| 5,529,193 | A | 6/1996 | Hytonen | |
| 5,638,267 | A | 6/1997 | Singhose et al. | |
| 5,785,191 | A | 7/1998 | Fedderma et al. | |
| 5,908,122 | A | 6/1999 | Robinett et al. | |
| 5,909,817 | A | 6/1999 | Wallace, Jr. et al. | |
| 5,938,052 | A | 8/1999 | Miyano et al. | |
| 5,960,969 | A | 10/1999 | Habisohn | |
| 5,961,563 | A | 10/1999 | Overton | |
| 6,050,429 | A | 4/2000 | Habisohn | |
| 6,102,221 | A | 8/2000 | Habisohn | |
| 6,505,085 | B1 * | 1/2003 | Tuttle et al. | 700/28 |
| 6,694,196 | B2 * | 2/2004 | Tuttle et al. | 700/28 |
| 6,920,378 | B2 | 7/2005 | Eloundou et al. | |
| 2003/0018400 | A1 * | 1/2003 | Tuttle et al. | 700/29 |
| 2008/0281464 | A1 | 11/2008 | Sorensen et al. | |

OTHER PUBLICATIONS

Fang et al., "Nonlinear Coupling Control Laws for a 3-DOF Overhead Crane System," 40th IEEE Conference of Decision and Control, Orlando, Florida, USA, 2001.

Kim et al., "A New Vision-Sensorless Anti-Sway Control System for Container Cranes," 38th IAS Annual Meeting, Industry Applications Conference, 2003.

Moustafa "Reference Trajectory Tracking of Overhead Cranes," Journal of Dynamic Systems, Measurement, and Control, vol. 123, pp. 139-141, 2001.

(Continued)

*Primary Examiner* — Emmanuel M Marcelo

(74) *Attorney, Agent, or Firm* — Thomas, Kayden, Horstemeyer & Risley, LLP

(57) ABSTRACT

Disclosed are various embodiments of methods and systems related to double-pendulum crane control. In one embodiment for determining a specified insensitivity (SI) input shaper for a double-pendulum crane, the method using a processor system to implement the steps including determining a plurality of insensitivity ranges based upon operational parameters associated with the double-pendulum crane; and determining SI input shaper parameters based upon tolerances corresponding to the plurality of insensitivity ranges, the SI input shaper parameters including an amplitude and a time corresponding to each impulse of the SI input shaper.

20 Claims, 6 Drawing Sheets

OTHER PUBLICATIONS

Fliess et al., "A Simplified Approach of Crane Control Via a Generalized State-Space Model," 30th Conference on Decision and Control, Brighton, England, 1991.
Gustafsson et al., "Automatic Control of Unmanned Cranes at the Pasir Panjang Terminal," 2002 IEEE International Conference on Control Applications, Glasgow, Scotland, U.K.
James Hyde and Warren Seering, "Using input command pre-shaping to suppress multiple mode vibration", Proc. of the IEEE Int. Conf. on Robotics and Automation, pp. 2604-2609, Sacramento, CA, Apr. 1991.
Attir Khalid, John Huey, William Singhose, and Jason Lawrence, "Human operator performance testing using an input-shaped bridge crane", ASME J. of Dynamic Systems, Measurement, and Control, vol. 128 No. 4 pp. 835-841, Dec. 2006.
Jason Lawrence and William Singhose, "Design of minicrane for education and research", 6th Int. Conf. on Research and Education in Mechatronics, 6 pages, Annecy, France, Jun. 2005.
Jason Lawrence, William Singhose, Rolff Weiss, Adrian Erb, and Urs Glauser, "An internet-driven tower crane for dynamics and controls education", IFAC Symp. on Control Education, 6 pages, Madrid, Jun. 2006.
Derek Lewis, Gordon G. Parker, Brian Driessen, and Rush D. Robinett, "Command shaping control of an operator-in-the-loop boom crane", Proc. of American Control Conference, pp. 2643-2647, Philadelphia, PA, Jun. 1998.
David P. Magee and Wayne J. Book, "Eliminating multiple modes of vibration in a flexible manipulator", Proc. of the IEEE Int. Conf. on Robotics and Automation, vol. 2 pp. 474-479, Atlanta, GA, May 1993.
G.G. Parker, K. Groom, J.E. Hurtado, J.T. Feddema, R.D. Robinett, and F. Leban, "Experimental verification of a command shaping boom crane control system", American Control Conference, pp. 86-90, San Diego, CA, Jun. 1999.
Neil Singer, William Singhose, and Eric Kriikku, "An input shaping controller enabling cranes to move without sway", Proc. of the ANS 7th Topical Meeting on Robotics and Remote Systems, vol. 1, pp. 225-231, Augusta, GA, Apr. 1997.
Neil C. Singer and Warren P. Seering "Preshaping command inputs to reduce system vibration", J. of Dynamic Systems, Measurement, and Control, vol. 112 pp. 76-82, Mar. 1990.
T. Singh, S. R. Vadali, and N. Abhyankar, "Robust time-delay control of multimode systems", Proc. of American Control Conference, pp. 681-685, Jun. 1994.
William Singhose and Samuel Towell, "Double-pendulum gantry crane dynamics and control", Proc. of the IEEE Conf. on Control Applications. Triste, Italy, Trieste, Italy, Sep. 1998.
William Singhose, Warren Seering, and Neil Singer, "Input shaping for vibration reduction with specified insensitivity to modeling errors", Japan-USA Symposium on Flexible Automation, vol. 1, pp. 307-313, Boston, MA, Jul. 1996.
William Singhose, Lisa Porter, Michael Kenison, and Eric Kriikku, "Effects of hoisting on the input shaping control of gantry cranes", Control Engineering Practice, vol. 8 No. 10 pp. 1159-1165, Oct. 2000.
O. J. M. Smith, Feedback Control Systems, pp. 331-345, McGraw-Hill Book Co., Inc., New York, 1958.
O. J. M. Smith, "Posicast control of damped oscillatory systems", Proc. of the IRE, vol. 45 pp. 1249-1255, Sep. 1957.
Khalid Sorensen, William Singhose, and Stephen Dickerson, "A controller enabling precise positioning and sway reduction in bridge and gantry cranes", Control Engineering Practice, vol. 15 No. 7 pp. 825-837, Jul. 2007.
G. P. Starr, "Swing-free transport of suspended objects with a pathcontrolled robot manipulator", J. of Dynamic Systems, Measurement and Control, vol. 107 pp. 97-100, Mar. 1985.
Nenad Zrnic, Zoran Petkovic, and Srdan Bosnjak, "Automation of ship-to-shore container cranes: A review of state-of-the-art", FME Transactions, vol. 33 No. 3 pp. 111-121, 2005.
J.W. Auernig and H. Troger, "Time optimal control of overhead cranes with hoisting of the load", Automatica, vol. 23 No. 4 pp. 437-446, Jul. 1987.
K.A.F. Moustafa and A.M. Ebeid, "Nonlinear modeling and control of overhead crane load sway", J. of Dynamic Systems, Measurement, and Control, vol. 110 pp. 266-271, Sep. 1988.
Y. Sakawa and Y. Shindo, "Optimal control of container cranes", Automatica, vol. 18 No. 3 pp. 257-266, May 1982.
H. Butler, G. Hondered, and J. Van Amerongen, "Model reference adaptive control of a gentry crane scale model", IEEE Control Systems, vol. 11 No. 1 pp. 57-62, Jan. 1991.
M. Kenison and W. Singhose, "Input shaper design for double-pendulum planar gantry cranes", IEEE Int. Conf. on Control Applications, pp. 539-544, Hawaii, Aug. 1999.
S. Tanaka and S. Kouno, "Automatic measurement and control of the attitude of crane lifters: lifter-attitude measurement and control", Control Engineering Practice, vol. 6 No. 9 pp. 1099-1107, Sep. 1998.
M. Kenison and W. Singhose, "Concurrent design of input shaping and proportional plus derivative feedback control", J. of Dynamic Systems, Measurement, and Control, vol. 124 No. 3 pp. 398-405, Sep. 2002.
L. Pao, T. Chang, and E. Hou, "Input shaper designs for minimizing the expected level of residual vibration in flexible structures", Proc. of American Control Conference, pp. 3542-3546, Albuquerque, NM, Jun. 1997.
U.H. Park, J.W. Lee, B.D. Lim, and Y.G. Sung, "Design and sensitivity analysis of an input shaping filter in the z-plane", J. of Sound and Vibration vol. 243 No. 1 pp. 157-171, May 2001.
W. Singhose, W. Seering, and N. Singer, "Residual vibration reduction using vector diagrams to generate shaped inputs", J. of Mechanical Design, vol. 116 No. 2 pp. 654-659, Jun. 1994.
W. Singhose, N. Singer, and W. Seering, "Time-optimal negative input shapers", J. of Dynamic Systems, Measurement, and Control, vol. 119 No. 2 pp. 198-205, Jun. 1997.
T. Singh and G.R. Heppler, "Shaped input control of a system with multiple modes", J. of Dynamic Systems, Measurement, and Control, vol. 115 No. 3 pp. 341-347, Sep. 1993.
W. Singhose, E. Crain, and W. Seering, "Convolved and simultaneous two-mode input shapers", IEEE Proc. of Control Theory and Applications, vol. 144 No. 6 pp. 515-520, Nov. 1997.
W. Singhose, W. Seering, and N. Singer, "Shaping inputs to reduce vibration: a vector diagram approach", Proc. of IEEE Int. Conf. on Robotics and Automation, vol. 2 pp. 922-927, May 1990.
B.K. Murphy and I Watanabe, "Digital shaping filers for reducing machine vibration". IEEE Trans. on Robotics and Automation, vol. 8 No. 2 pp. 285-289, Apr. 1992.
G.G. Parker, K. Groom, J.E. Hurtado, J.T. Feddema, R.D. Robinett, and F. Leban, "Command shaping boom crane control system with non-linear inputs", Proc. of the IEEE Int. Conf. on Control Applications, pp. 1774-1778, Hawaii, Aug. 1999.
D.R. Strip, "Swing-free transport of suspended objects: a general treatment", IEEE Trans. on Robotics and Automation, vol. 5 No. 2 pp. 234-236, Apr. 1989.
R. Smith, G. Starr, R. Lumia and J. Wood, "Preshaped Trajectories for Residual Vibration Suppression in Payloads Suspended from Multiple Robot Manipulators", Proc. of IEEE Int. Conf. on Robotics and Automation, pp. 1599-1603, Apr. 2004.
J.F. Jones and B.F. Petterson, "Oscillation damped movement of suspended objects", Proc. of IEEE Int. Conf. on Robotics and Automation, pp. 956-962, Apr. 1988.
Lahres, S., Aschemann, H., Sawodny, O., and Hofer, E. P., 2000, "Crane Automation by Decoupling Control of a Double Pendulum Using Two Translational Actuators," in Proceedings of the 2000 American Control Conference, vol. 2, pp. 1052-1056.
K. Sato and Y. Sakawa, "Modeling and control of a flexible rotary crane," Int. Journal of Control, vol. 48, No. 5, pp. 2085-2105, 1988.

* cited by examiner

METHODS AND SYSTEMS FOR DOUBLE-PENDULUM CRANE CONTROL

CROSS REFERENCE TO RELATED APPLICATIONS

This application claims priority to copending U.S. provisional application entitled "INPUT SHAPING CONTROLLER FOR DOUBLE-PENDULUM CRANE" having Ser. No. 61/025,110, filed Jan. 31, 2008, which is hereby incorporated by reference in its entirety.

BACKGROUND

Cranes occupy a crucial role within industry. They are used throughout the world in thousands of shipping yards, construction sites, steel mills, warehouses, nuclear power and waste storage facilities, and other industrial complexes. The significant role that these systems maintain in the world can hardly be overestimated.

Cranes are highly flexible in nature, generally responding in an oscillatory manner to external disturbances and motion of the overhead support unit (e.g., the bridge or trolley). In many applications this oscillation has adverse consequences. Swinging of the payload or hook makes precision positioning time consuming and inefficient for an operator. This condition is exacerbated in double-pendulum cranes where the payload motion is a combination of oscillations at two different frequencies. The oscillations of the payload and/or hook can present control problems for operators and safety hazards to both personnel and equipment.

SUMMARY

Embodiments of the present disclosure are related to methods and systems for double-pendulum crane control.

Briefly described, one embodiment, among others, comprises a method for determining a specified insensitivity (SI) input shaper for controlling a double-pendulum crane. The method comprises determining a plurality of insensitivity ranges based upon operational parameters associated with the double-pendulum crane; and determining SI input shaper parameters based upon tolerances corresponding to the plurality of insensitivity ranges, the SI input shaper parameters including an amplitude and a time corresponding to each impulse of the SI input shaper.

Another embodiment, among others, comprises a double-pendulum crane system. The system comprises an input control configured to transmit an input command in response to an operator input; and a specified insensitivity (SI) input shaper module including a SI input shaper. The SI input shaper module is configured to: receive the input command; convolve the input command with the SI input shaper to produce the shaped velocity command; and transmit the shaped velocity command to a crane drive system configured to control movement of the double-pendulum crane in response to the velocity impulse command.

Another embodiment, among others, comprises a double-pendulum crane system. The system comprises means for providing an input command in response to an operator input; means for providing a shaped velocity command in response to the input command based upon a specified insensitivity (SI) input shaper; and means for controlling movement of the double-pendulum crane in response to the velocity impulse command.

Other systems, methods, features, and advantages of the present disclosure will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
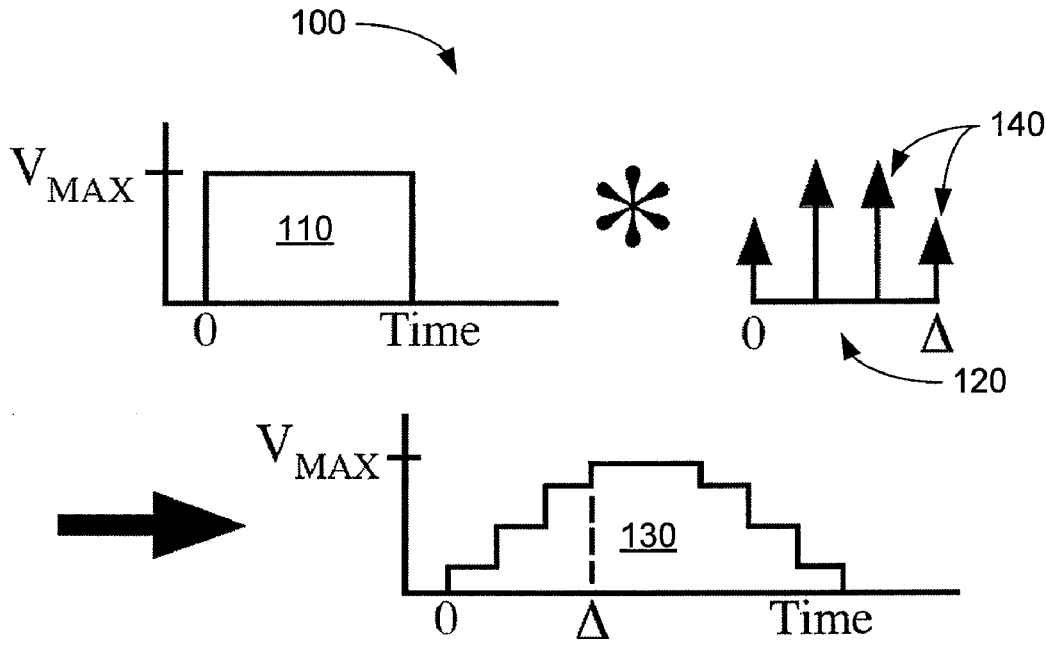
FIG. 1 illustrates an input shaping process according to the present disclosure.

Disclosed herein are various embodiments of methods and systems related to double-pendulum crane control. Reference will now be made in detail to the description of the embodiments as illustrated in the drawings, wherein like reference numbers indicate like parts throughout the several views.

Cranes are often driven by pressing on-off buttons that issue constant-velocity commands to the crane. On-off inputs tend to induce substantial payload oscillations. Therefore, a practical real-time oscillation controller filters out unwanted excitations from the human-generated command signal. This can be accomplished by convolving the human-generated command with a sequence of impulses. FIG. 1 illustrates an input shaping process 100 according to the present disclosure. As demonstrated in FIG. 1, an input command 110 is convolved with an input shaper 120 to produce a shaped velocity command 130, which may be applied to the crane. In FIG. 1, the input shaper 120 contains four impulses 140 distributed with the time of the final input shaper impulse at time A. In other implementations, the number, amplitude, and distribution of the impulses 140 of the input shaper 120 may vary. Convolving the input command 110 with the input shaper 120 produces the staircase function of the shaped velocity command 130. Proper timing and scaling of the impulses 140 can ensure that the payload oscillation is suppressed to within a desired tolerance.

Figure 2:
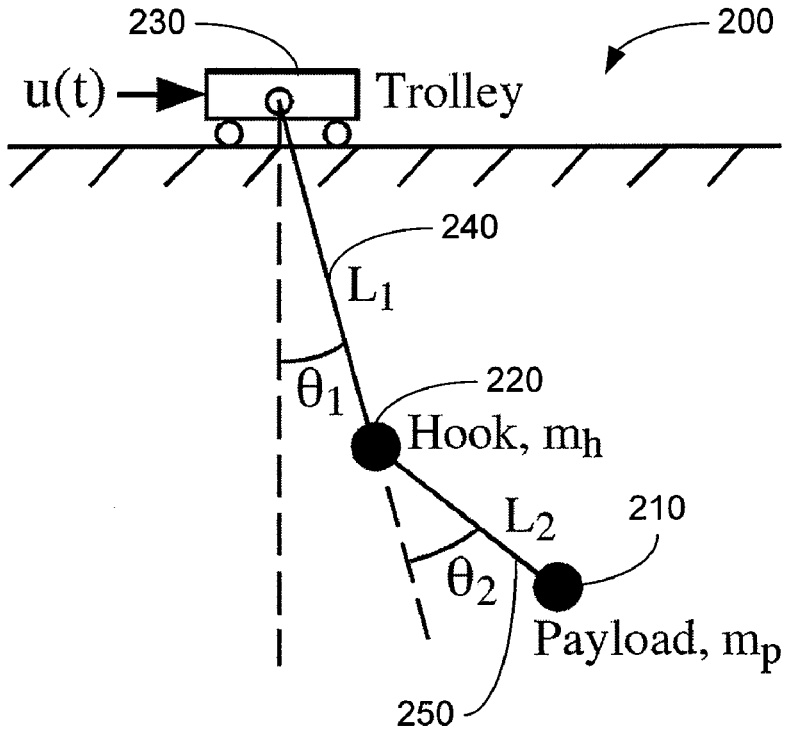
FIGS. 2 and 3 are graphical representations of double-pendulum cranes with different payload configurations according to the present disclosure.
Figure 3:
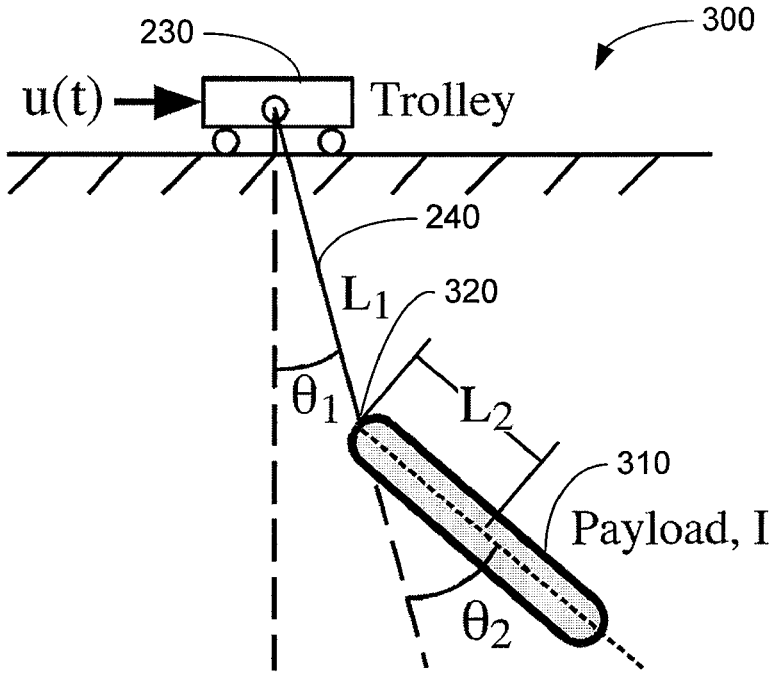

Many cranes operate with a single-pendulum oscillation mode. However, under certain conditions double-pendulum dynamics can arise. For example, these effects occur when a lumped payload is suspended a significant length below the crane hook, as shown in FIG. 2. FIG. 2 is a graphical representation of a double-pendulum crane 200 with a payload 210 that can be approximated as a point mass suspended at a distance $L_2$ below a connection point 220 (e.g., a hook). In FIG. 2, the payload 210 forms a secondary pendulum that rotates about the connection point to the hook 220. Double-pendulum effects can also occur when the payload is an extended body with significant inertia, as illustrated in FIG. 3. FIG. 3 is a graphical representation of a double-pendulum crane 300 with an extended body (or distributed) payload 310 suspended below a connection point 320. In FIG. 3, the payload 310 forms a secondary pendulum that rotates about the connection point 320 with a distance of $L_2$ to the payload center of mass. Double-pendulum effects can also occur for other payload shapes and distributions. Determination of the input shaper 120 for double-pendulum cranes presents added difficulty because of the added dynamics of the secondary pendulum. To make the determination, the dynamics of the double-pendulum crane are considered.

In the example of FIG. 2, the double-pendulum crane 200 is moved by applying a force, u(t), to the trolley 230. A cable 240 (or other suitable means for connection) of length $L_1$ hangs below the trolley 230 and supports a hook 220, of mass $m_h$, to which the payload 210 is attached using rigging cable 250 (or other suitable means for connection). Here the rigging cable 250 and payload 210 are modeled as having length $L_2$ and point mass $m_p$. Assuming that the cable length does not change, the linearized equations of motion, assuming zero initial conditions, are:

$$\ddot{\theta}_1(t) = -\left(\frac{g}{L_1}\right)\theta_1 + \left(\frac{gR}{L_1}\right)\theta_2 - \frac{u(t)}{L_1} \tag{1}$$

$$\ddot{\theta}_2(t) = \left(\frac{g}{L_1}\right)\theta_1 - \left(\frac{g}{L_2} + \frac{gR}{L_2} + \frac{gR}{L_1}\right)\theta_2 + \frac{u(t)}{L_1}$$

where $\theta_1$ and $\theta_2$ describe the swing angles of the two pendulums, R is the ratio of the payload mass to the hook mass, and g is the acceleration due to gravity. Double-pendulum crane dynamics can also arise when the payload 310 is a long distributed mass connected to a massless hook as illustrated in FIG. 3. While the equations of motion that can be derived for such a payload differ from those given above in equation (1), the input-shaping techniques presented in this disclosure will still be effective, provided that the two oscillation frequencies in such a system can be reasonably approximated. Similarly, the disclosed input-shaping techniques can be applied to other payload shapes and distributions using derived equations of motion.

The linearized frequencies of the double-pendulum dynamics modeled above in equation (1) are:

$$\omega_{1,2} = \sqrt{\frac{g}{2}}\sqrt{(1+R)\left(\frac{1}{L_1}+\frac{1}{L_2}\right) \mp \beta} \tag{2}$$

where, $$\beta = \sqrt{(1+R)^2\left(\frac{1}{L_1}+\frac{1}{L_2}\right)^2 - 4\left(\frac{1+R}{L_1 L_2}\right)} \tag{3}$$

The two pendulum oscillation frequencies ($\omega_{1,2}$) depend on the two cable lengths ($L_1$, $L_2$) and the mass ratio (R). It is of interest to investigate how the frequencies change as a function of the system parameters. Such information can be used to design an effective input-shaping controller.

Figure 4:
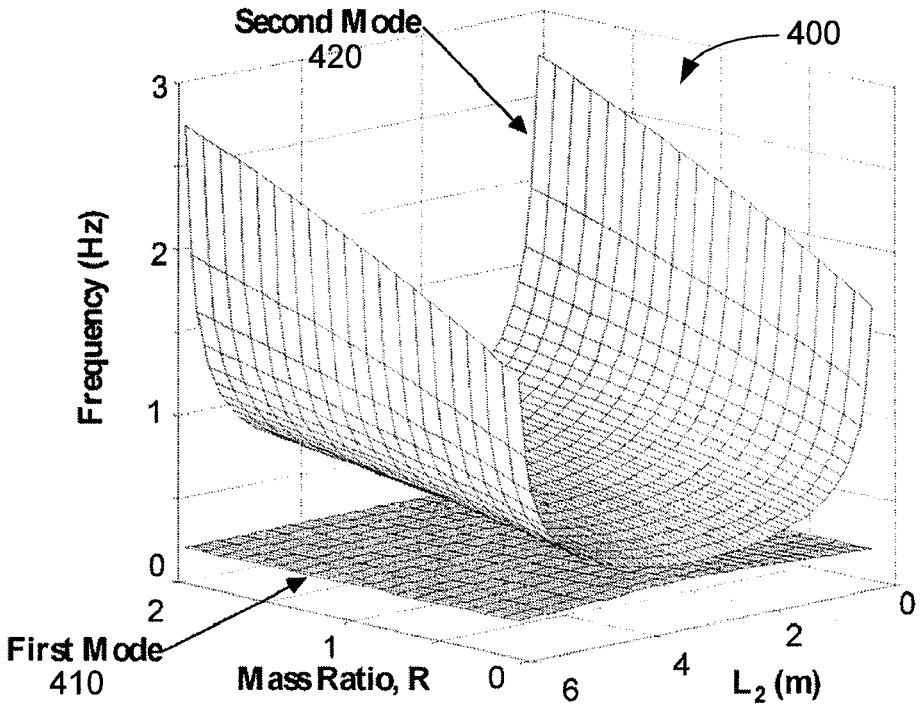
FIG. 4 is a graphical representation of the variation of the oscillation frequencies of a double-pendulum crane such as those in of FIGS. 2 and 3 according to the present disclosure.

Consider a subset of crane manipulation tasks where the sum of the two cable lengths stays constant. FIG. 4 is a graphical representation 400 of the variation of the low and high oscillation frequencies ($\omega_{1,2}$) as a function of the mass ratio R and the rigging cable length $L_2$, when the total length ($L_1$+$L_2$) is held constant at 6 meters. The low frequency (first mode 410) changes very little and corresponds closely to the frequency of a single 6 m pendulum. On the other hand, the second mode 420 (high frequency) has a strong dependence on the rigging cable length $L_2$.

The low frequency (first mode 410) is maximized when the two cable lengths are equal, $L_1$=$L_2$ (e.g., 3 m in the embodiment of FIG. 4). This maximum condition can be proven by differentiating the expression for $\omega_1$ given above in equation (2) with respect to $L_2$ and then setting the result equal to zero. Note that over the wide range of parameter values (R and $L_2$) shown in FIG. 4, the low frequency only varies between 0.2040 Hz and 0.2521 Hz. This is an 11% variation of the first mode 410 about the median frequency value of 0.2281 Hz. In contrast, the second mode 420 deviates by 78% about its median frequency value over the same parameter ranges.

The variations of the first and second modes (410 and 420) of FIG. 4 indicate that an oscillation control scheme that is more robust to variations in the second mode 420 than in the first mode 410 may be desirable. However, if the amplitude of the second mode 420 is very small compared to the first mode 410, then the controller may not need to address the second-mode effects. The relative contribution of the two modes can be examined by breaking the overall dynamic response into the separate components arising from $\omega_1$ and $\omega_2$.

The responses of the two swing angles, $\theta_1$ and $\theta_2$, to an impulse of magnitude A, introduced at time $t_0$, are:

$$\theta_1(t) = \frac{A\omega_1(1+\omega_2^2 L_1\alpha)}{k}\sin(\omega_1(t-t_0)) - \frac{A\omega_2(1+\omega_1^2 L_1\alpha)}{k}\sin(\omega_2(t-t_0)) \tag{4}$$

$$\theta_2(t) = \frac{A\omega_1}{k}\sin(\omega_1(t-t_0)) - \frac{A\omega_2}{k}\sin(\omega_2(t-t_0)) \tag{5}$$

where, $$\alpha = \frac{-g(1+R)}{\omega_1^2\omega_2^2 L_1 L_2}, \text{ and } k = \beta L_1 g \tag{6}$$

Assuming small swing angles, then the impulse response of the payload 210 in the horizontal direction can be approximated as:

$$\text{where, } x(t) = C_1\sin(\omega_1 t + \psi_1) + C_2\sin(\omega_2 t + \psi_2) \tag{7}$$

$$C_1 = \frac{\omega_1 L_1(1+\omega_2^2\alpha(L_1+L_2))}{k}\sqrt{\left(\sum_{j=1}^{n} A_j\cos(\omega_1 t_j)\right)^2 + \left(\sum_{j=1}^{n} A_j\sin(\omega_1 t_j)\right)^2} \tag{8}$$

-continued $$C_2 = \frac{-\omega_2 L_1(1+\omega_1^2\alpha(L_1+L_2))}{k}\sqrt{\left(\sum_{j=1}^{n} A_j\cos(\omega_2 t_j)\right)^2 + \left(\sum_{j=1}^{n} A_j\sin(\omega_2 t_j)\right)^2} \quad (9)$$

The two coefficients, $C_1$ and $C_2$, indicate the contributions of each mode to the overall payload response. In the case of payloads 310 (FIG. 3) with extended bodies or other distributions, the impulse response is approximated about the center of mass. The displacement at other points along the payload 310 distribution can be extrapolated using the payload 310 dimensions.

To design an input shaper 120 (FIG. 1) to move double-pendulum cranes 200/300 with very little residual vibration (or oscillation), the maximum amplitude of the residual vibration from a series of impulses may be limited. Because $\omega_1 \neq \omega_2$ and the damping for each mode is approximately zero, the maximum vibration amplitude of the payload 210/310 response can be approximated by adding the maximum amplitudes from each mode, $C_1$ and $C_2$:

$$V_{amp} = |C_1| + |C_2| \quad (10)$$

Based on this relationship, the contribution of the second mode becomes apparent and indicates when two-mode input shaping may be needed. For example, in the embodiment of FIG. 4, the contribution of the second mode 420 is particularly large in relation to the contribution of the first mode 420 when the suspension and rigging lengths ($L_1$ and $L_2$) are approximately equal (about 3 meters). It can also be seen that the contribution of the second mode 420 decreases as the mass ratio increases. These relationships indicated that double-pendulum input shaping may be effective for systems with low payload-to-hook mass ratios and suspension and rigging lengths that are approximately equal.

The maximum residual vibration amplitude given above in equation (10) can be used as a constraint equation by constraining the vibration amplitude, $V_{amp}$, to less than some tolerable threshold value, $V_{tol}$. Robustness of the crane 200/300 control over a range of operational conditions may be improved if the vibration is limited to a small value, rather than forced to be exactly zero. In the limiting case, when $V_{tol}$ is set equal to zero, the constraints reduce to two-mode Zero Vibration (ZV) constraints. An expression for percentage of residual oscillation amplitude can be formed by dividing the amplitude when input shaping is used by the amplitude without input shaping:

$$V(\omega_n, \zeta) = e^{-\zeta\omega_n t_n}\sqrt{[C(\omega_n, \zeta)]^2 + [S(\omega_n, \zeta)]^2} \quad (11)$$

where, $$C(\omega_n, \zeta,) = \sum_{j=1}^{n} A_j e^{\zeta\omega_n t_j}\cos(\omega_d t_j) \quad (12)$$

$$S(\omega_n, \zeta,) = \sum_{j=1}^{n} A_j e^{\zeta\omega_n t_j}\sin(\omega_d t_j) \quad (13)$$

$A_i$ and $t_i$ are the amplitudes and time locations of the impulses 140 in the input shaper 120 (FIG. 1). A constraint on the residual vibration can be expressed as:

$$V_{tol} \geqq V(\omega_n, \zeta) \quad (14)$$

While limiting percentage vibration is theoretically convenient, equation (10) allows the residual oscillation (or vibration) amplitude to be limited to specific dimensions values. In this case, $V_{tol}$ can expressed as the sum of the maximum dimensional amplitudes from each mode, $C_1$ and $C_2$.

The vibration caused by an input shaper 120 (FIG. 1) can be limited, but if the impulse 140 (FIG. 1) amplitudes are not constrained, then their values can range between positive and negative infinity. In one embodiment, the magnitude of the impulses 140 is limited to below a specific value to overcome this problem. In another embodiment, all the impulses 140 have positive values, i.e.:

$$A_i > 0.\ i = 1, \ldots n \quad (15)$$

where n is the number of impulses 140 in the input shaper 120. A second amplitude constraint is enforced so that the shaped command 130 (FIG. 1) reaches the desired setpoint; i.e., the impulse amplitudes sum to one:

$$\sum_{i=1}^{n} A_i = 1 \quad (16)$$

The constraint in (14) can be used twice to limit the vibration at a set of pendulum oscillation frequencies ($\omega_1$ and $\omega_2$). If the actual crane 200/300 frequencies coincide with those used to design the input shaper 120, then the oscillation will be eliminated. However, to ensure robustness to modeling errors and parameter variations, the oscillation can be suppressed at several points near the modeling frequencies, as illustrated in FIG. 5.

Figure 5:
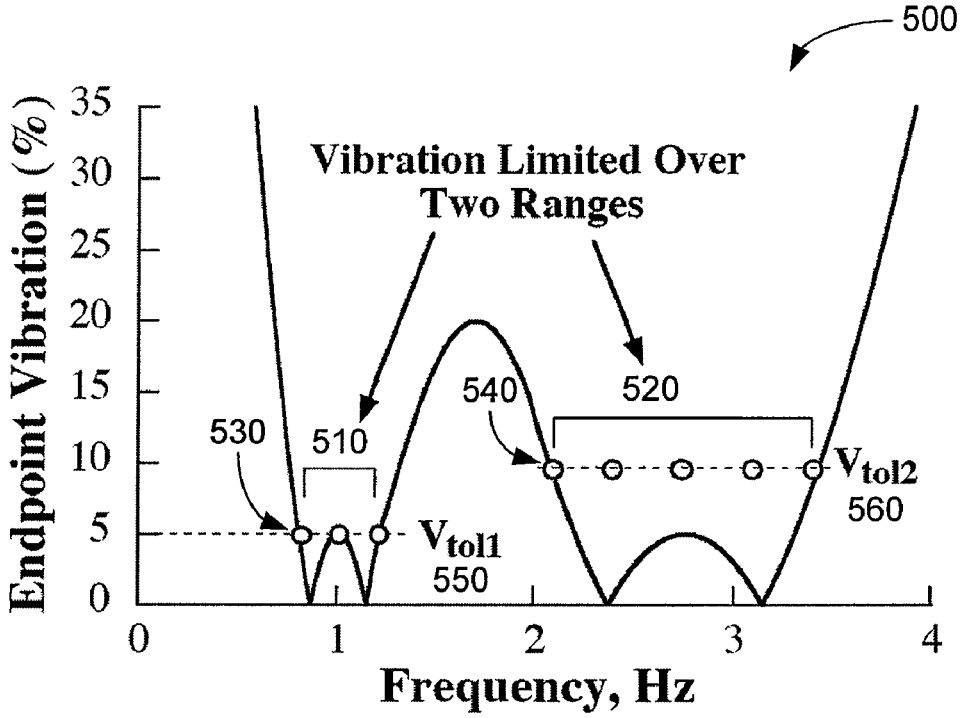
FIG. 5 is a graphical representation of frequency suppression of endpoint vibration over two ranges of the double-pendulum crane of FIG. 2 according to the present disclosure.

FIG. 5 is a graphical representation 500 of frequency suppression of endpoint vibration over two frequency ranges (510 and 520) of the double-pendulum crane 200 of FIG. 2 according to the present disclosure. In FIG. 5, three points 530 are suppressed over the lower frequency range 510 and five points 540 over the higher frequency range 520. Ranges 510 and 520 define ranges of frequencies (suppression ranges) over which the vibration remains below the tolerable limits, $V_{tol1}$ 550 and $V_{tol2}$ 560, respectively. In some embodiments, the number of suppressed points can be between 3 and 7 for each range. In other embodiments, more than 7 points may be suppressed. In one embodiment, the suppressed points may be evenly distributed over the frequency range. In other embodiments, the suppressed points may be distributed about the center frequency of the high and low frequency ranges at predetermined increments (e.g., 5%, 10%, 0.05 Hz, or 0.1 Hz). For example, if the center frequency is 1 Hz and a range of ±10% is to be suppressed, then constraints may be defined at 5% increments about the center frequency (i.e., 0.9, 0.95, 1, 1.05, and 1.1 Hz). Other distributions may also be utilized. The resulting input shapers 120, which are determined based upon the distributed suppression points, are called Specified Insensitivity (SI) input shapers.

A final design constraint is to minimize the duration of the input shaper 120 (i.e., minimize the time (Δ of FIG. 1) of the final input shaper impulse). To summarize, two-mode SI input shapers are designed by minimizing the input shaper duration (Δ) while satisfying the impulse 140 amplitude constraints (e.g., equations (15) and (16) above) and using the vibration tolerance, $V_{tol}$), (14), to limit vibration over two frequency ranges that contain frequencies that are expected to be encountered during operation of the double-pendulum crane 200/300.

Figure 6:
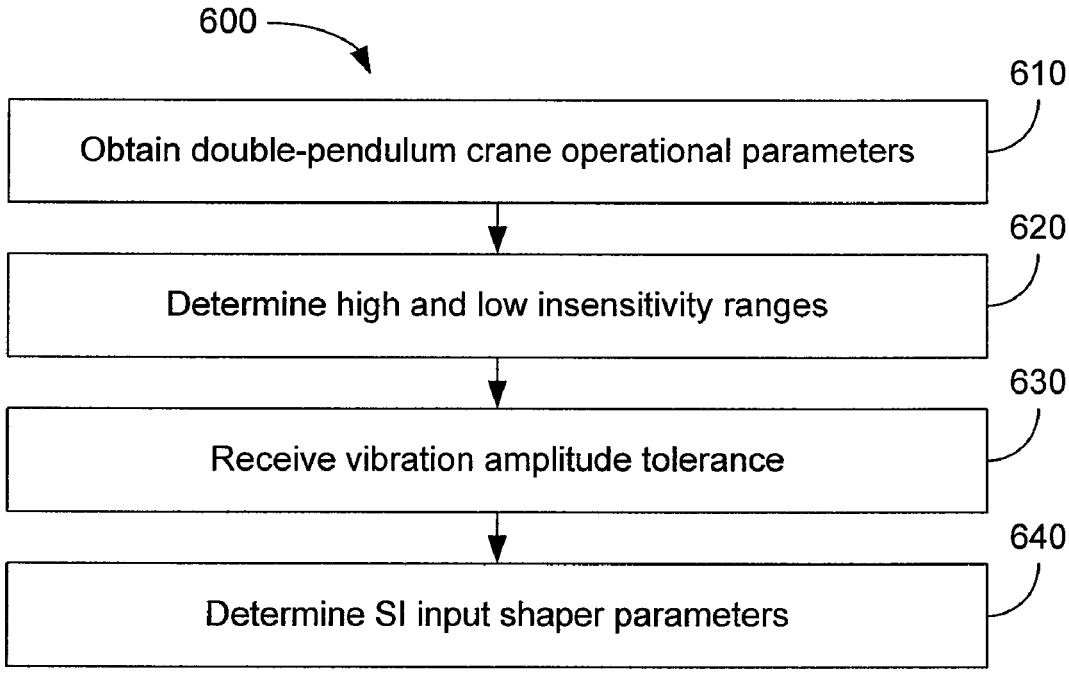
FIG. 6 is a flow diagram illustrating a method for determining a double-pendulum crane input shaper for the input shaping process of FIG. 1 according to the present disclosure.

FIG. 6 is a flow diagram 600 illustrating a method for determining a double-pendulum crane 200/300 input shaper 120 for the input shaping process 100 of FIG. 1 according to the present disclosure. In the example of FIG. 6, operational parameters for a double-pendulum crane 200/300 being analyzed are obtained in block 610. Operational parameters may include, but are not limited to, ranges of suspension lengths (e.g., maximum and minimum cable lengths $L_1$ and $L_2$ of FIGS. 2 and 3), payload ranges (e.g., variations in payload mass $m_p$ of FIG. 2), and connection information (e.g., hook mass $m_h$ of FIG. 2). In distributed payloads 310, such as illustrated in FIG. 3, the payload 310 geometry and mass distribution may be used to determine operational parameters of the double-pendulum crane 300. In one embodiment, the parameters are entered by a user. Alternatively, the parameters may be provided by a manufacturer of the crane 200/300. In some embodiments, operational parameters such as, but not limited to, cable lengths and payload dimensions and/or mass may be automatically determined based upon information obtained by crane sensors such as vision systems (e.g., cameras or other imaging devices and/or scanning equipment), load cells, strain gages, and encoders. In other embodiments, the parameters are retrieved from memory. For example, a database may include operational parameters which may be accessed based on a manufacturer model, design, and/or serial number.

The low and high insensitivity ranges (e.g., 510 and 520 of FIG. 5) for the double-pendulum crane 200/300 being analyzed are determined in block 620. The insensitivity ranges (i.e., frequency ranges to be suppressed) may be determined using linearized frequencies based on modeled double-pendulum dynamics. For example, for the double-pendulum crane 200 of FIG. 2, the insensitivity ranges may be determined using equations (2) and (3) by analyzing different combinations of operational parameters. Insensitivity ranges for other payload 310 (FIG. 3) distributions may be determined using linearized frequencies based on the modeled double-pendulum dynamics for that payload 310 distribution. Alternatively, other payload 310 distributions may be modeled as a point mass payload 210 to utilize equations (2) and (3).

In some embodiments, the range limits may be the set by the highest and lowest frequencies determined based on the operational parameters. In other embodiments, a margin for error may be added to the highest and lowest frequencies to set the range limits. Alternatively, a nominal frequency may be determined and a range about the nominal frequency (e.g., ±20%) may be used to define the insensitivity ranges.

The vibration (or oscillation) amplitude tolerance is received in block 630. The allowable total tolerance, $V_{tol}$, will depend on the application and the user's requirements. For example, at nuclear power plants it is common for crane payloads 210/310 to be positioned within a two inch tolerance. Cranes 200/300 utilized in ports for positioning containers on trucks for transport may need an accuracy of about three inches. Alternatively, some applications may need a crane positioning accuracy of one centimeter or less. A dimensional tolerance can be converted to a percentage tolerance based upon a vibration response to baseline movement of the payload 210/310. In some cases, this baseline move could be a move that causes the most endpoint vibration or oscillation.

In some embodiments, tolerances for the low and high ranges, $V_{tol1}$ 550 and $V_{tol2}$ 560 (FIG. 5), are entered by a user. To illustrate one such procedure for choosing $V_{tol1}$ 550 and $V_{tol2}$ 560, consider the case when the second mode (high frequency) is expected to contribute half the amplitude of vibration contributed by the first mode (low frequency). That is, $$V(\omega_1,\zeta)=2V(\omega_2,\zeta) \tag{17}$$

Given that the vibration from both modes will combine to given the total vibration, we have:

$$V(\omega_1,\zeta)+V(\omega_2,\zeta)=V_{tol} \tag{18}$$

Therefore, if the first mode is limited to $V_{tol1}=\epsilon$, then the limit on the second mode can be set twice as large, $V_{tol2}=2\epsilon$. To find the value of $\epsilon$, we satisfy:

$$V_{tol1}+V_{tol2}=V_{tol} \tag{19}$$

The result in this case is $\epsilon=(1/3)V_{tol}$.

In other embodiments, the total vibration tolerance, $V_{tol}$, is received and used to determine the tolerances for the low and high ranges, $V_{tol1}$ 550 and $V_{tol2}$ 560. Alternatively, embodiments may utilize other variations such as, but not limited to:

1. Use the same $V_{tol}$ for both the low and high frequency ranges.

2. Receive a constant $V_{tol1}$ for the low frequency range and vary $V_{tol2}$ until the combined vibration from mode 1 and mode 2 reach the tolerable overall level, $V_{tol}$. By loosening the constraints of $V_{tol2}$, the input shaper 120 (FIG. 1) duration may be shortened.

3. Vary both $V_{tol1}$ and $V_{tol2}$ while satisfying the limit on vibration tolerance, and minimize the input shaper 120 duration.

4. Vary $V_{tol1}$ and/or $V_{tol2}$ as a function of the frequency over each frequency suppression range.

Figure 7:
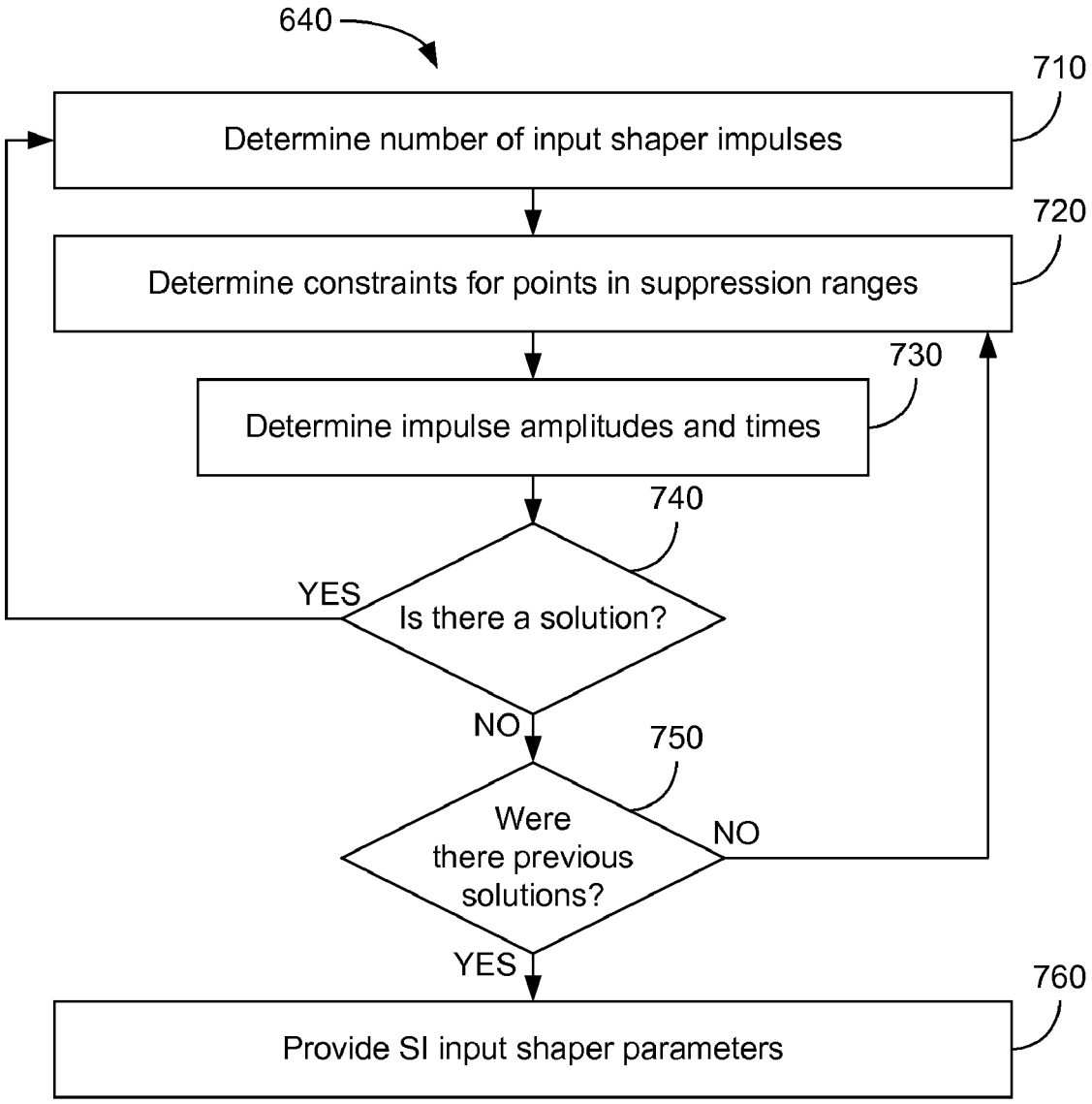
FIG. 7 is a flow diagram illustrating a method for determining the Specified Insensitivity (SI) input shaper parameters of FIG. 6 according to the present disclosure.

In block 640, the parameters (e.g., impulse number, amplitudes, and times) are determined for the SI input shaper 120. The impulse 140 (FIG. 1) constraints such as, but not limited to, positive amplitudes only, negative impulses with specified amplitudes, and unity magnitude impulses will affect the form of the input shaper 120. FIG. 7 is a flow diagram illustrating a method for determining the SI input shaper parameters 640 of FIG. 6 according to the present disclosure. In block 710, the number of impulses 140 is determined. In one embodiment, the initial number of impulses 140 is predetermined. In other embodiments, the initial number of impulses 140 may be determined based on the number of suppression points and/or size of the suppression ranges.

Constraints based on vibration tolerances, $V_{tol1}$ and $V_{tol2}$, are determined for the suppression points in each range in block 720. Constraint equations (11)-(14) may be used to limit the vibration below a vibration tolerance level, $V_{tol1}$, over the low frequency range and the vibration tolerance level, $V_{tol2}$, over the high frequency range. The impulse 140 amplitudes and time locations are determined so as to minimize the duration of the input shaper 120 in block 730. In some embodiments, computer programs such as, but not limited to, MATLAB® and other numerical analysis programs or software, may be used to find the impulse amplitudes and times that satisfy the vibration constraints by minimizing (e.g., using a minimization command with a minimization tolerance) the duration of the SI input shaper 120 (i.e., the smallest time location of the last impulse 140). In other embodiments, the constraints may be iteratively solved until the change or the rate of change in the last impulse time is within a predefined tolerance. The response time of the crane controller is maximized by minimizing the duration of the SI input shaper 120.

If there is a solution to determining the impulse amplitudes and times based on the constraints (block 740), then the SI input shaper parameters (e.g., impulse number, amplitudes, and times) are saved and the method returns to block 710. The number of input shaper impulses is reduced by one (block 710) and impulse amplitudes and times are determined (block 730) based on revised constraints (block 720). This sequence continues until there is no solution available for the current number of impulses.

If there is have been no solutions to the determination of impulse 140 amplitudes and times (block 750), then the number or suppression points is increased and the method returns to block 720. In one embodiment, one or more additional suppression points are added to both the low and high ranges. In other embodiments, one or more points are added to only a single range.

If there has been a solution to the determination of impulse 140 amplitudes and times (block 750), then SI input shaper 120 parameters from the solution with the shortest duration are provided in block 760. In alternative embodiments, the vibration tolerances for the low and high frequency ranges may also be iteratively adjusted to minimize the duration of the input shaper 120.

Figure 8:
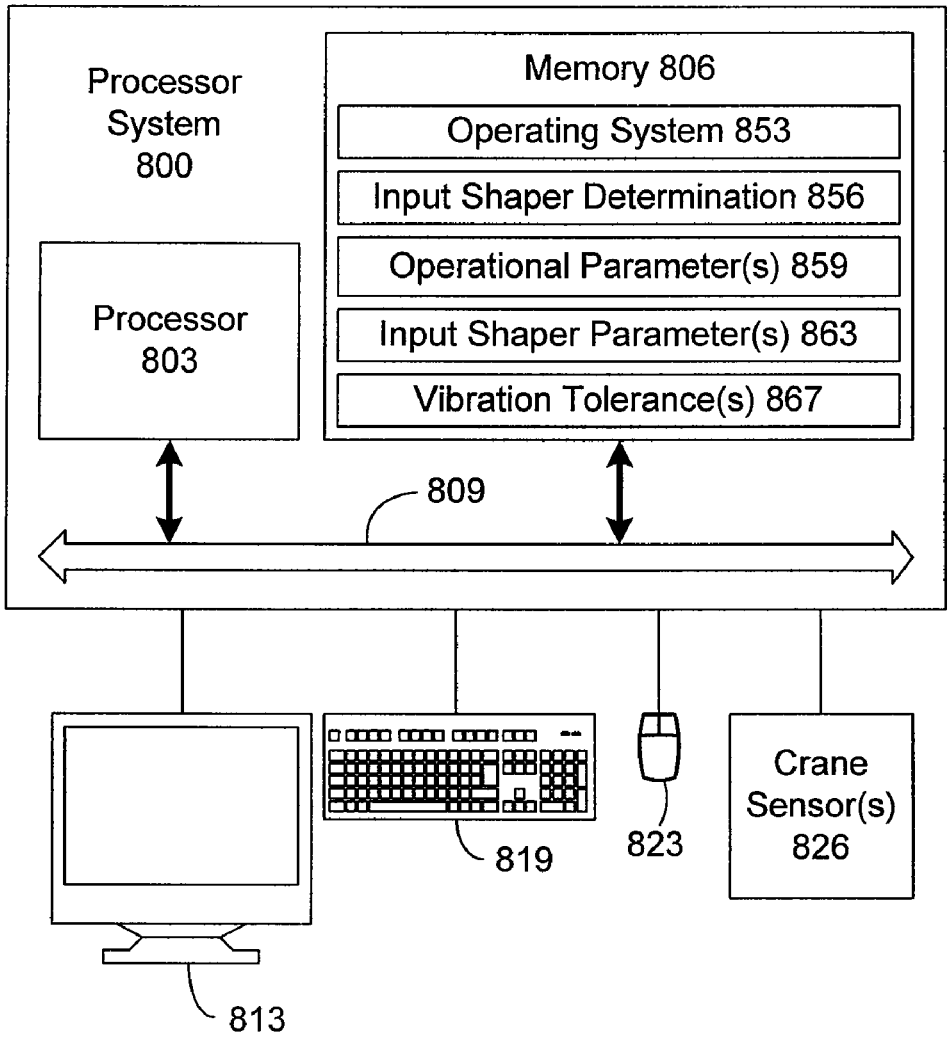
FIG. 8 is a schematic block diagram of one example of a system employed to perform various analysis with respect to input shaper determination according to the present disclosure.

Referring next to FIG. 8, shown is one example of a system that performs various functions using input shaper 120 (FIG. 1) determination according to the various embodiments as set forth above. As shown, a processor system 800 is provided that includes a processor 803 and a memory 806, both of which are coupled to a local interface 809. The local interface 809 may be, for example, a data bus with an accompanying control/address bus as can be appreciated by those with ordinary skill in the art. The processor system 800 may comprise, for example, a computer system such as a server, desktop computer, laptop, personal digital assistant, or other system with like capability.

Coupled to the processor system 800 are various peripheral devices such as, for example, a display device 813, a keyboard 819, and a mouse 823. In addition, other crane sensors 826 (peripheral devices that allow for the capture of various operational parameters for a crane system 200/300) may be coupled to the processor system 800 such as, for example, vision or image capture devices (e.g., cameras or other imaging devices and/or scanning equipment), load cells, strain gages, and encoders. The image capture device may comprise, for example, a digital camera or other such device that generates images that comprise patterns to be analyzed to determine system parameters such as, but not limited to, suspension and rigging cable lengths, payload 210/310 dimensions, and connector and/or payload 210/310 oscillations. Encoders may be used to determine changes in cable lengths and crane 200/300 position. Load sensors may be used to determine connector and/or payload 210/310 mass.

Stored in the memory 806 and executed by the processor 803 are various components that provide various functionality according to the various embodiments of the present disclosure. In the example shown, stored in the memory 806 is an operating system 853 and an input shaper determination system 856. In addition, stored in the memory 806 are various operational parameters 859, input shaper parameters 863, and vibration (or oscillation) tolerances 867. The operational parameters 859 may be associated with a corresponding crane and payload combination. Other information that may be stored in memory 806 includes, but is not limited to, crane manufacturer database(s), payload dimensions and weights, double-pendulum dynamics and constraint equations, and numerical analysis programs and software (e.g., MATLAB®). The operational parameters 859, input shaper parameters 863, and vibration (or oscillation) tolerances 867 may be stored in a database to be accessed by the other systems as needed. The operational parameters 859 may comprise ranges of suspension lengths, payload ranges, and connection information. In the case of distributed payloads 310 (FIG. 3), operational parameters 859 may also comprise the payload geometry and mass distribution.

The input shaper determination system 856 is executed by the processor 803 in order to determine SI input shaper 120 (FIG. 1) parameters as described above. A number of software components are stored in the memory 806 and are executable by the processor 803. In this respect, the term "executable" means a program file that is in a form that can ultimately be run by the processor 803. Examples of executable programs may be, for example, a compiled program that can be translated into machine code in a format that can be loaded into a random access portion of the memory 806 and run by the processor 803, or source code that may be expressed in proper format such as object code that is capable of being loaded into a of random access portion of the memory 806 and executed by the processor 803, etc. An executable program may be stored in any portion or component of the memory 806 including, for example, random access memory, read-only memory, a hard drive, compact disk (CD), floppy disk, or other memory components.

The memory 806 is defined herein as both volatile and nonvolatile memory and data storage components. Volatile components are those that do not retain data values upon loss of power. Nonvolatile components are those that retain data upon a loss of power. Thus, the memory 806 may comprise, for example, random access memory (RAM), read-only memory (ROM), hard disk drives, floppy disks accessed via an associated floppy disk drive, compact discs accessed via a compact disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

The processor 803 may represent multiple processors and the memory 806 may represent multiple memories that operate in parallel. In such a case, the local interface 809 may be an appropriate network that facilitates communication between any two of the multiple processors, between any processor and any one of the memories, or between any two of the memories etc. The processor 803 may be of electrical, optical, or molecular construction, or of some other construction as can be appreciated by those with ordinary skill in the art.

The operating system 853 is executed to control the allocation and usage of hardware resources such as the memory, processing time and peripheral devices in the processor system 800. In this manner, the operating system 853 serves as the foundation on which applications depend as is generally known by those with ordinary skill in the art.

The flow charts of FIGS. 6 and 7 show the architecture, functionality, and operation of an implementation of the input shaper determination system 856. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor in a computer system or other system. The machine code may be converted from the source code, etc. If embodied in hardware, each block may represent a circuit or a number of interconnected circuits to implement the specified logical function(s).

Although flow charts of FIGS. 6 and 7 show a specific order of execution, it is understood that the order of execution may differ from that which is depicted. For example, the order of execution of two or more blocks may be scrambled relative to the order shown. Also, two or more blocks shown in succession in FIGS. 6 and 7 may be executed concurrently or with partial concurrence. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, where the input shaper determination system 856 may comprise software or code, it can be embodied in any computer-readable medium for use by or in connection with an instruction execution system such as, for example, a processor in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the input shaper determination system 856 for use by or in connection with the instruction execution system. The computer readable medium can comprise any one of many physical media such as, for example, electronic, magnetic, optical, electromagnetic, infrared, or semiconductor media. More specific examples of a suitable computer-readable medium would include, but are not limited to, magnetic tapes, magnetic floppy diskettes, magnetic hard drives, or compact discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

Figure 9:
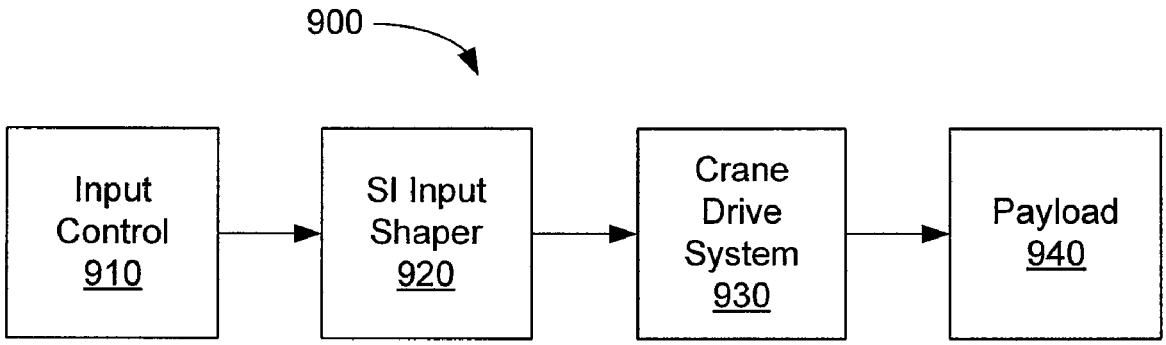
FIG. 9 is an illustration of the SI input shaper determined in FIG. 7 used in a crane control system according to the present disclosure.

FIG. 9 is an illustration of the SI input shaper 120 (FIG. 1) determined in FIG. 7 used in a crane control system 900 according to the present disclosure. In FIG. 9, a signal from an input control 910 is received by the SI input shaper module 920. Input controls 910 used by a human operator for positioning of the crane 200/300 and payload 210/310 can include, but is not limited to, push button and joy stick controls. For example, a push button control may include six directional buttons (Up, Down, Right, Left, Forward, Reverse) that are pressed to issue input commands 110 (FIG. 1) to the crane 200/300.

The SI input shaper module 920 receives the input command, shapes a shaped velocity command 130 (FIG. 1) based on the determined SI input shaper 120 (FIG. 1) parameters, and sends the shaped velocity command 130 to the drive system 930 (e.g., drives and motors) of the crane 200/300. The crane's drive system 930 moves the crane 200/300 and the attached payload 940 (200/300) in response to the shaped velocity command 130. Shaping of the shaped velocity command 130 suppresses oscillations of the payload 940 (210/310). In some embodiments, the SI input shaper module 920 may be incorporated into either the input control 910 or the crane drive system 930. In an exemplary embodiment, the SI input shaper module 920 uses a single SI input shaper 120 under all operational conditions. In alternative embodiments, a payload 210/310 may be identified (e.g., using an imaging device to identify the load configuration or read a bar code) and a corresponding SI input shaper 120 selected by the SI input shaper module 920 for use. In other embodiments, operational parameters such as, but not limited to, cable lengths and payload dimensions and/or mass may be automatically determined during crane 200/300 operation based upon information obtained by crane sensors such as vision systems (e.g., cameras or other imaging devices and/or scanning equipment), load cells, strain gages, and encoders. In some embodiments, the operational parameters may be used by the SI input shaper module 920 to adaptively select the SI input shaper 120 to meet the existing operational conditions. Alternatively, the SI input shaper module 920 may change the SI input shaper 120 in response to an operator input or a predefined schedule (e.g., when the crane 200/300 is operating within a predefined area).

The SI input shaper module 920 of certain embodiments of the present disclosure can be implemented in hardware, software, firmware, or a combination thereof. In the preferred embodiment(s), the SI input shaper module 920 is implemented in firmware or software that is stored in a memory and that is executed by a suitable instruction execution system. If implemented in hardware, as in an alternative embodiment, the SI input shaper module 920 can be implemented with any or a combination of the following technologies, which are all well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

One embodiment of an SI input shaper 120 (FIG. 1) was developed and tested based on a 10-ton industrial bridge crane. A double pendulum was formed by attaching a payload 210 to the hook 220 of the crane 200 with a rigging cable 250. This arrangement can be modeled by double-pendulum crane of FIG. 2. The initial length ($L_1$ of FIG. 2) of the suspension cable was approximately 3.8 m and the rigging length ($L_2$ of FIG. 2) was approximately 2.3 m. However, the suspension length ($L_1$) changes as operators perform hoisting operations of the payload. The mass of the hook ($m_h$ of FIG. 2) is approximately 50 kg and two different payloads were used during testing ($m_p$ of 4.5 kg and 13.6 kg).

Figure 10:
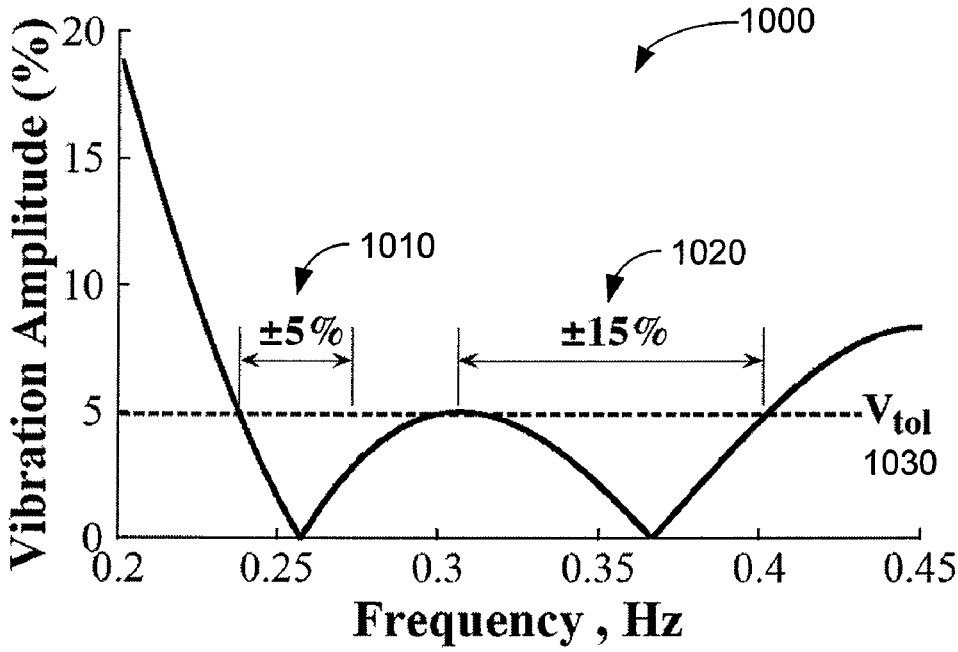
FIG. 10 is a graphical representation of frequency suppression of endpoint vibration of the test crane and payload according to the present disclosure.

The SI input shaper 120 was designed to suppress 0.25 Hz and 0.35 Hz modes, which correspond to the crane 200 frequencies when it moves a 9 kg payload 210 having a mass (i.e., the average mass of the two test payloads). Given the uncertainty in the crane 200 parameters and the changes in suspension length $L_1$ that occur during hoisting, the SI input shaper 120 needs a moderate amount of robustness. FIG. 10 is a graphical representation 1000 of frequency suppression of endpoint vibration of the test crane 200 and payload 210 according to the present disclosure. In FIG. 10, the SI input shaper 120 was designed to accommodate a ±5% variation around the low frequency mode 1010 and a ±15% variation for the high frequency mode 1020. In this implementation, a common $V_{tol}$ 1030 was used for both modes (i.e., $V_{tol}=V_{tol1}=V_{tol2}$). In this case $V_{tol1}$ and $V_{tol2}$ where both set to 5%. The SI input shaper 120 parameters for these design constraints are given by:

$$\begin{bmatrix} A_i \\ t_i \end{bmatrix} = \begin{bmatrix} 0.166 & 0.334 & 0.334 & 0.166 \\ 0 & 1.330 & 2.627 & 3.957 \end{bmatrix}, i = 1, \ldots, 4 \tag{20}$$

Note that the insensitivity constraints for the two modes are close together, so the combined effect limits all frequencies from 0.24 Hz to 0.40 Hz.

Figure 11:
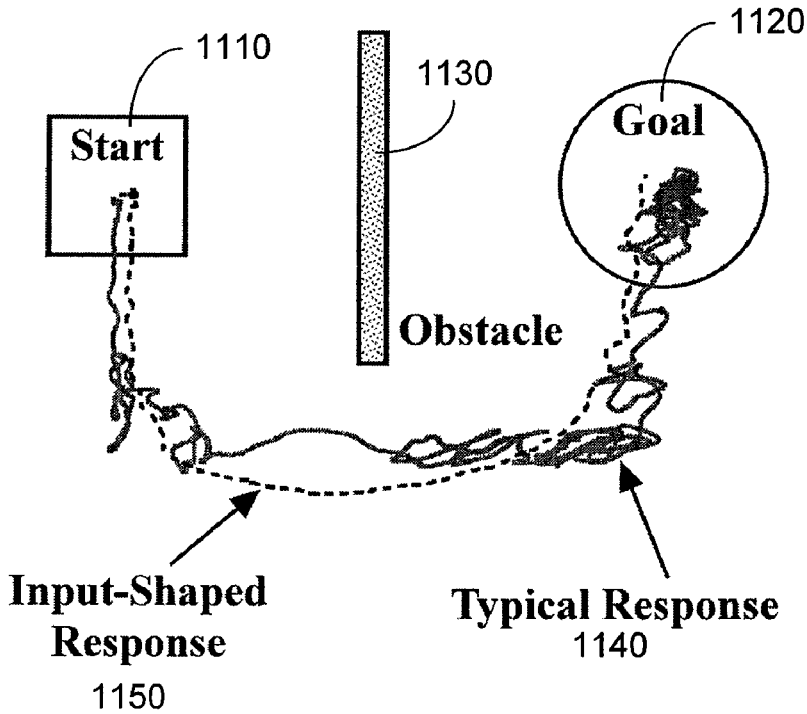
FIG. 11 illustrates a comparison of test crane and payload vibration with and without the SI input shaper of FIG. 10 according to the present disclosure.

The impact of the SI input shaper 120 (FIG. 1) can be illustrated by a point-to-point motion test. FIG. 11 illustrates a comparison of test crane 200 and payload 210 vibration with and without the SI input shaper of FIG. 10 according to the present disclosure. A crane operator moved the payload from a START area 1110 (a 0.25 $m^2$ square) to an END region 1120 (a 0.75 m diameter circle) that was two meters away, as shown in FIG. 11. An obstacle 1130 was placed between the START area 1110 and END region 1120 to force the operator to maneuver around the 1.2 m wide by 1.2 m tall obstacle 1130.

Operators used an operator pendent connected to the crane 200 by a cable as the input control 910 (FIG. 9). The operator pendent included six directional buttons (Up, Down, Right, Left, Forward, Reverse) that are pressed to issue input commands to the crane 200. The human operators drove the crane 200 with and without SI input shaping, and with both payloads 210 of 4.5 kg and 13.6 kg. The bridge crane 200 has an overhead vision system (e.g., a digital camera with controls and storage) that can track the motion of the hook. FIG. 11 shows the double-pendulum responses of the crane hook 220 for a manipulation task under standard operation 1140 and also with the SI input shaping enabled 1150. The two responses are from the same human operator with the same payload 210. As can be seen from FIG. 11, SI input shaping 120 significantly reduced the oscillations produced during the payload transfer.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The invention claimed is:

1. A method for determining a specified insensitivity (SI) input shaper for controlling a double-pendulum crane, the method using a processor system to implement the steps comprising:

determining a plurality of insensitivity ranges based upon operational parameters associated with the double-pendulum crane;

determining SI input shaper parameters based upon tolerances corresponding to the plurality of insensitivity ranges, the SI input shaper parameters including an amplitude and a time corresponding to each impulse of the SI input shaper; and controlling the double-pendulum crane based at least in part on the SI input shaper parameters.

2. The method of claim 1, wherein the plurality of insensitivity ranges includes a low frequency range and a high frequency range.

3. The method of claim 2, wherein determining a plurality of insensitivity ranges comprises:

determining a nominal low frequency for the double-pendulum crane and a corresponding variation about the nominal low frequency based upon the double-pendulum crane operational parameters; and determining a nominal high frequency for the double-pendulum crane and a corresponding variation about the nominal high frequency based upon the double-pendulum crane operational parameters.

4. The method of claim 3, wherein the corresponding variation about the nominal low frequency is a percentage of the nominal low frequency and the corresponding variation about the nominal high frequency is a percentage of the nominal high frequency.

5. The method of claim 2, wherein determining a plurality of insensitivity ranges comprises:

determining a maximum frequency and a minimum frequency corresponding to the low frequency range based upon the double-pendulum crane operational parameters; and determining a maximum frequency and a minimum frequency corresponding to the low frequency range based upon the double-pendulum crane operational parameters.

6. The method of claim 1, wherein determining SI input shaper parameters comprises:

determining constraints for a plurality of suppression points in each of the plurality of insensitivity ranges base on the corresponding tolerances; and determining the amplitude and the time corresponding to each impulse of the SI input shaper based upon the determined constraints.

7. The method of claim 6, wherein the plurality of suppression points in at least one of the plurality of insensitivity ranges is a predefined number of suppression points.

8. The method of claim 7, wherein the plurality of suppression points in at least one of the plurality of insensitivity ranges are evenly distributed over the insensitivity range.

9. The method of claim 6, wherein the amplitude and the time corresponding to each impulse are determined by iteratively minimizing the duration of the SI input shaper.

10. The method of claim 9, wherein the duration of the SI input shaper is minimized when the change in the time of a last impulse of the SI input shaper is within a predefined tolerance.

11. The method of claim 1, further comprising providing the SI input shaper parameters to a SI input shaper module for control of the double-pendulum crane.

12. The method of claim 1, further comprising obtaining the operational parameters associated with the double-pendulum crane.

13. A double-pendulum crane system, comprising:

an input control configured to transmit an input command in response to an operator input; and a specified insensitivity (SI) input shaper module utilizing a SI input shaper comprising a series of impulses, the amplitude and time of each impulse based upon a plurality of insensitivity ranges associated with a double-pendulum crane, the SI input shaper module configured to:

receive the input command;

convolve the input command with the SI input shaper to produce a shaped velocity command; and transmit the shaped velocity command to a crane drive system configured to control movement of the double-pendulum crane in response to the velocity impulse command.

14. The double-pendulum crane system of claim 13, wherein the plurality of insensitivity ranges are based upon operational parameters associated with the double-pendulum crane, at least one operational parameter based upon information obtained by a crane sensor.

15. The double-pendulum crane system claim 13, wherein the plurality of insensitivity ranges includes a low frequency range and a high frequency range.

16. The double-pendulum crane system of claim 13, wherein the SI input shaper module is further configured to select the SI input shaper from a plurality of SI input shapers based on information obtained by a crane sensor.

17. The double-pendulum crane system of claim 13, further comprising a vision system configured to identify a payload.

18. The double-pendulum crane system of claim 17, wherein the SI input shaper module is further configured to select the SI input shaper from a plurality of SI input shapers, the selected SI input shaper corresponding to the identified payload.

19. A double-pendulum crane system, comprising:

means for providing an input command in response to an operator input;

means for providing a shaped velocity command in response to the input command based upon a specified insensitivity (SI) input shaper comprising a series of impulses, the amplitude and time of each impulse based upon a plurality of insensitivity ranges associated with a double-pendulum crane; and means for controlling movement of the double-pendulum crane in response to the velocity impulse command.

20. The double-pendulum crane system of claim 19, further comprising means for selecting the SI input shaper based upon information obtained by a crane sensor.

* * * * *